US005217266A

United States Patent [19]

Köstler

[11] Patent Number: 5,217,266

[45] Date of Patent: Jun. 8, 1993

[54] DOOR LOCK WITH A SERVOMOTOR FOR ROTATING A LOCKING PIN ABOUT AN ECCENTRIC AXIS

[75] Inventor: Ulrich Köstler, Hebertshausen, Fed. Rep. of Germany

[73] Assignee: Bayerische Motoren Werke AG, Fed. Rep. of Germany

[21] Appl. No.: 731,090

[22] Filed: Jul. 17, 1991

[30] Foreign Application Priority Data

Jul. 18, 1990 [DE] Fed. Rep. of Germany ..... 4022811

[51] Int. Cl.[5] ..... E05B 15/02

[52] U.S. Cl. ..... 292/201; 292/341.16; 292/216; 49/280

[58] Field of Search ..... 292/201, 341.16, DIG. 43, 292/216; 49/280

[56] References Cited

U.S. PATENT DOCUMENTS

| | | | |
|---|---|---|---|
| 4,707,007 | 11/1987 | Inoh | 292/341.16 |
| 4,775,178 | 10/1988 | Boyko | 292/341.16 |
| 4,823,059 | 4/1989 | Compeau et al. | 292/341.16 |
| 4,842,313 | 6/1989 | Boyko et al. | 292/341.16 |
| 4,862,640 | 9/1989 | Boyko et al. | 49/280 |
| 4,887,390 | 12/1989 | Boyko et al. | 49/280 |
| 4,982,984 | 1/1991 | Yokota et al. | 292/341.16 |
| 5,066,056 | 11/1991 | Schap | 292/341.16 |

FOREIGN PATENT DOCUMENTS

| | | | |
|---|---|---|---|
| 8902964 | 4/1989 | European Pat. Off. . | |
| 0393595 | 4/1990 | European Pat. Off. . | |
| 3401842 | 8/1985 | Fed. Rep. of Germany . | |
| 4006593 | 9/1990 | Fed. Rep. of Germany | 292/341.16 |

OTHER PUBLICATIONS

1984 Electrical and Climate Control New Model Features–pp. 34 & 35.

*Primary Examiner*—Eric K. Nicholson

*Attorney, Agent, or Firm*—Evenson, McKeown, Edwards & Lenahan

[57] ABSTRACT

A lock with a servomotor, particularly a door lock for a motor vehicle, having a lock latch (fork member 1) which can be shifted between an open position and a detent position. In the detent position, the lock latch (fork member 1) reaches behind a pin 3 which, in the detent position, can be rotated by the servomotor about an eccentric axis from a prelocking position into a main locking position.

8 Claims, 3 Drawing Sheets

FIG. 1
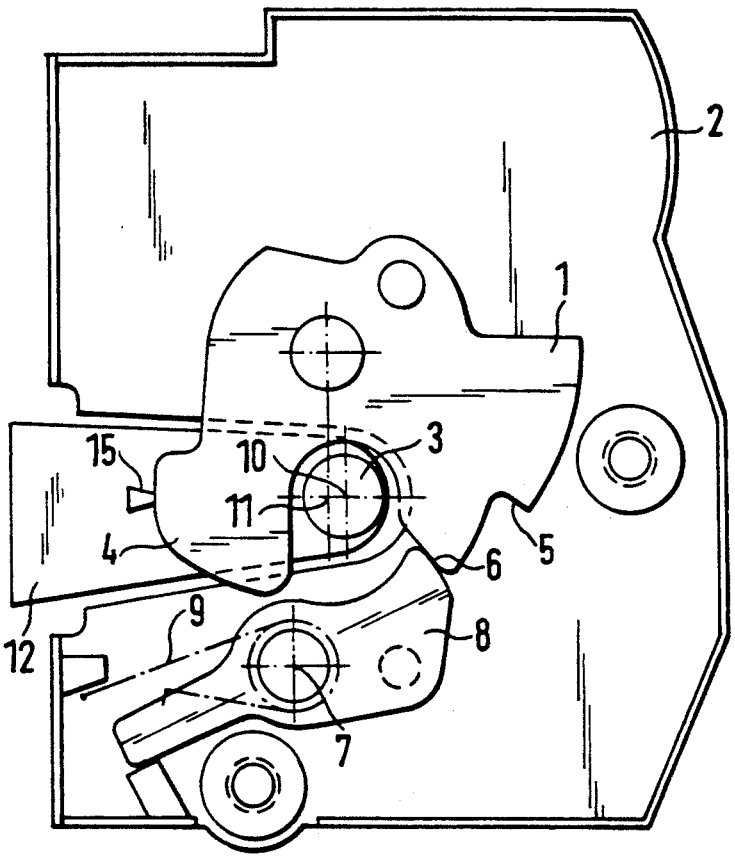
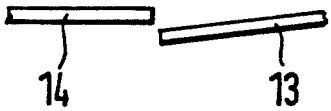
FIG. 1A

DOOR LOCK WITH A SERVOMOTOR FOR ROTATING A LOCKING PIN ABOUT AN ECCENTRIC AXIS

BACKGROUND AND SUMMARY OF THE INVENTION

The present invention relates to a lock with a servomotor, particularly a door lock for a motor vehicle, having a lock latch which can be displaced between an open position and a detent position. The lock latch, in the detent position, reaches behind a locking element which, in the detent position, can be shifted by the servomotor from a prelocking position into a main locking position.

A lock of the above type having a servomotor is known from the German Patent Document DE-OS 34 01 842 and is provided for the locking of a motor vehicle door, of a motor vehicle hood, or the like. In the lock, a displaceable lock latch is provided which, in each case, in a predetent position and in a main detent position, reaches behind a clamp. The locking of the vehicle door, the vehicle hood, or the like, may be made difficult, for example, because of a sealing element which is elastically deformed shortly before the complete locking and thus causes a resistance force in the opening direction. The resistance force during the locking is overcome by a servomotor which, when the lock latch is in the main detent position, displaces the clamp from a prelocking position into a main locking position. As a result, the vehicle door, vehicle hood, or the like, is easy to lock but, for this purpose, either an expensive straight-line mechanism for the clamp or a carrier receiving the clamp or a swivelling carrier for the clamp must be provided which requires a corresponding clearance for the swivelling. The lock also requires large clearances for a cable pull with a cable pulley interacting with the clamp which increases the overall space requirement significantly. Because of several deflecting rollers and large deflecting angles, the durability of the cable pull cable is impaired which, because of the high force transmission and the shock-caused stresses transferred from the lock latch to the clamp during the locking, requires a relatively large diameter. A measure is also taken to ensure that the cable pull cable is always tightly tensioned because otherwise the clamp can carry out small movements which, when the lock is used on a motor vehicle, cause rattling noises during the driving operation.

An object of the invention is to provide a lock with a servomotor which has a simple construction and requires little installation space. In addition, the structural member to be locked by means of the lock must be reliably locked.

This and other objects are achieved by the present invention which provides a door lock with a servomotor for a motor vehicle that has a lock latch displaceable between an open position and a detent position, a servomotor, and a pin serving as a locking element for the lock latch. The pin is coupled to the servomotor such that the pin 3 is rotatable about an eccentric axis by the servomotor from a prelocking position into a main locking position, the lock latch reaching behind the pin in the detent position.

It is particularly advantageous that the lock requires only slight changing measures in comparison to the known locks. The eccentric bearing and the construction of the pin results in low expenditures with respect to costs and labor. In an unobtrusive and space-saving manner, a servomotor, which is formed, for example, by an electric motor with a reducing gear connected behind it, can, in a covered manner, act upon the pin. When the pin, during the locking and possibly during the opening, is turned out of a dead center position of the pin, a particularly harmonious sequence of motions is obtained which causes no or only minimal noise.

Other objects, advantages and novel features of the present invention will become apparent from the following detailed description of the invention when considered in conjunction with the accompanying drawings.

BRIEF DESCRIPTION OF THE DRAWINGS

FIG. 1 is a view of the pin on a element of a lock constructed in accordance with am embodiment of the present invention, with the pin being in the prelocking position when the lock latch is in the detent position.

FIG. 1*a* is a top view of the prelocking position of the vehicle door corresponding to FIG. 1.

DETAILED DESCRIPTION OF THE DRAWINGS

Figure 2:
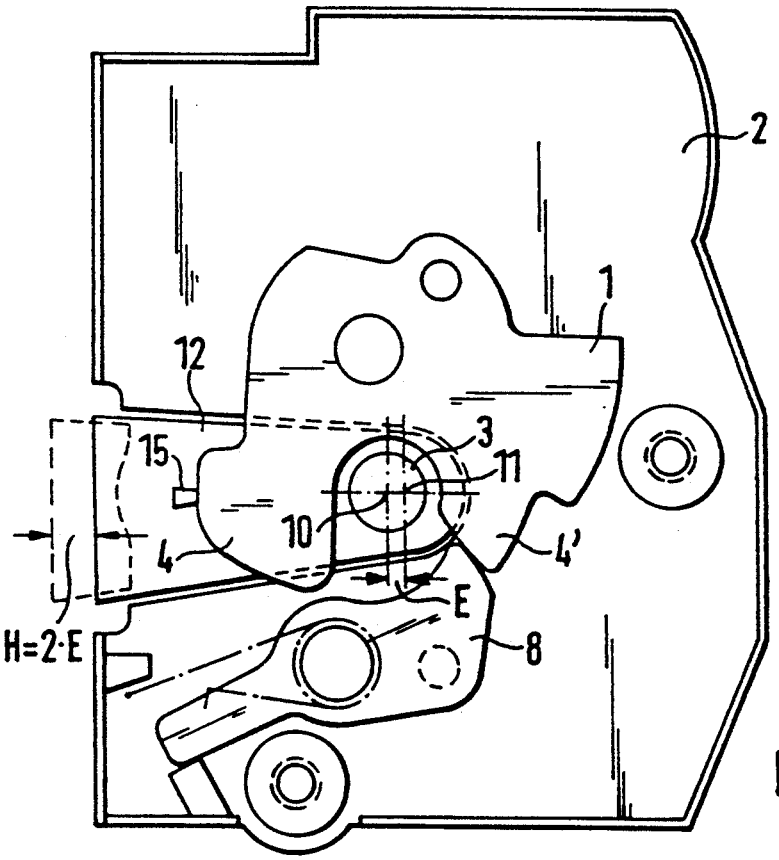
FIG. 2 is a view corresponding to FIG. 1 in the main locking position of the pin.

The lock illustrated in FIG. 1 is provided on a vehicle door of a motor vehicle and has a lock latch constructed as a fork member 1. In the embodiment, the fork member 1 can be swivelled, on a lock plate 2 connected with the vehicle door from an open position, by way of a predetent position, into the shown main detent position in which, in a known manner, a leg 4 of the fork member 1 reaches behind a pin 3 or the like. The fork member 1 has a predetent 5 and a main detent 6. In the illustrated main detent position, the fork member 1 is prevented from a displacement into the open position by means of a catch 8 which can be swivelled about the axis 7 on the lock plate 2 between a release position releasing the fork member 1 and the illustrated locking position. The catch 8 is loaded into the locking position by means of a leg spring 9 shown by a dash-dotted line, and the fork member 1 is loaded into the open position by means of a spring which is not shown. The cross-sectionally circular pin 3 is arranged so that it can be rotated about an axis 11 on a element 12 which is eccentric with respect to its axis 10. The element 12 is fastened to a vertical column of a door frame receiving the vehicle door.

FIG. 1*a*, in a basic diagram, illustrates the position of the vehicle door 13 with respect to the column 14 of the door frame receiving the vehicle door 13. As mentioned above, in this position, the pin 3 is in its prelocking position, and the fork member 1 is in its main detent position.

The pin 3 can be displaced by a servomotor 16 (see FIG. 3), by an angle of approximately 180 degrees about the eccentric axis 11, which is in parallel to the axis 10 of the pin 3, from the prelocking position illustrated in FIG. 1, into the main locking position illustrated in FIG. 2. As indicated on the left side of the drawing of FIG. 2 by interrupted lines, when the pin 3 is rotated from its prelocking position into its main locking position, the element 12 is displaced relative to the fork member 2 by the measurement H, which corresponds to twice the eccentricity E of the axis 10 of the pin 3 with respect to its eccentric axis 11. For reasons of simplicity, FIG. 2 shows the relative path of the element 12 with respect to the fork member 1. However, it is clear that, in the case of this rotation of the pin 3, it is not the element 12 stationary at the vehicle that is adjusted, but conversely, the vehicle door with the lock plate 2, the fork member 1 and the catch 8 as well as other parts is displaced by the measurement H with respect to the element 12. In the present construction, conversely, the pin 3 can be rotated from its main locking position corresponding to FIG. 2 into the prelocking position according to FIG. 1 by means of the servomotor 16. Since, in the case of the illustrated embodiment, the pin 3, in the prelocking position and in the main locking position, is, in each case, in a dead-center position, the motor-caused movement of the vehicle door from the prelocking position into the main locking position and vice versa into the prelocking position is particularly harmonious with respect to its sequence.

During the displacement of the vehicle door from the prelocking position into the main locking position, a door seal arranged in the door frame is elastically deformed which, as a result, causes a resistance force loading the vehicle door into the open position. However, the vehicle door can be easily locked because a slight slamming of the door is sufficient for shifting the vehicle door into the prelocking position and, with the aid of the servomotor 16, from the prelocking position against the resistance force of the door seal, into the main locking position. The play between the pin 3 and the legs 4, 4' of the fork member 1 illustrated in FIGS. 1 and 2 in an exaggerated manner, in the case of the embodiment, in reality, is only slight so that, when the pin 3 is rotated, no or almost no noise will be generated. In addition, the vehicle door is supported by the element 12 in a manner known per se.

A switch 15, which is symbolically outlined in FIGS. 1 and 2, during the locking of the lock, detects the detent position of the fork member 1 and switches on the servomotor 16 in the prelocking position until the main locking position is reached. Since the fork member 1 is already in its main detent position, and the catch 8 is in its locking position, no other displacement of parts is required in order to ensure that the catch 8 prevents the fork member 1 from being displaced into an open position. In an exemplary embodiment, the servomotor 16 is formed by an electric motor and a gearing connected behind it which interacts, for example, with a gearwheel connected with the pin 3. This is shown in more detail in FIG. 3.

Figure 2A:
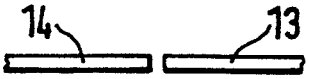
FIG. 2*a* is a top view of the main locking position of vehicle door corresponding to FIG. 2.

The schematic representation according to FIG. 2*a* shows that when the lock is in the main locking position according to FIG. 2, the vehicle door is flush with the shell of the vehicle body and with the column 14.

Figure 3:
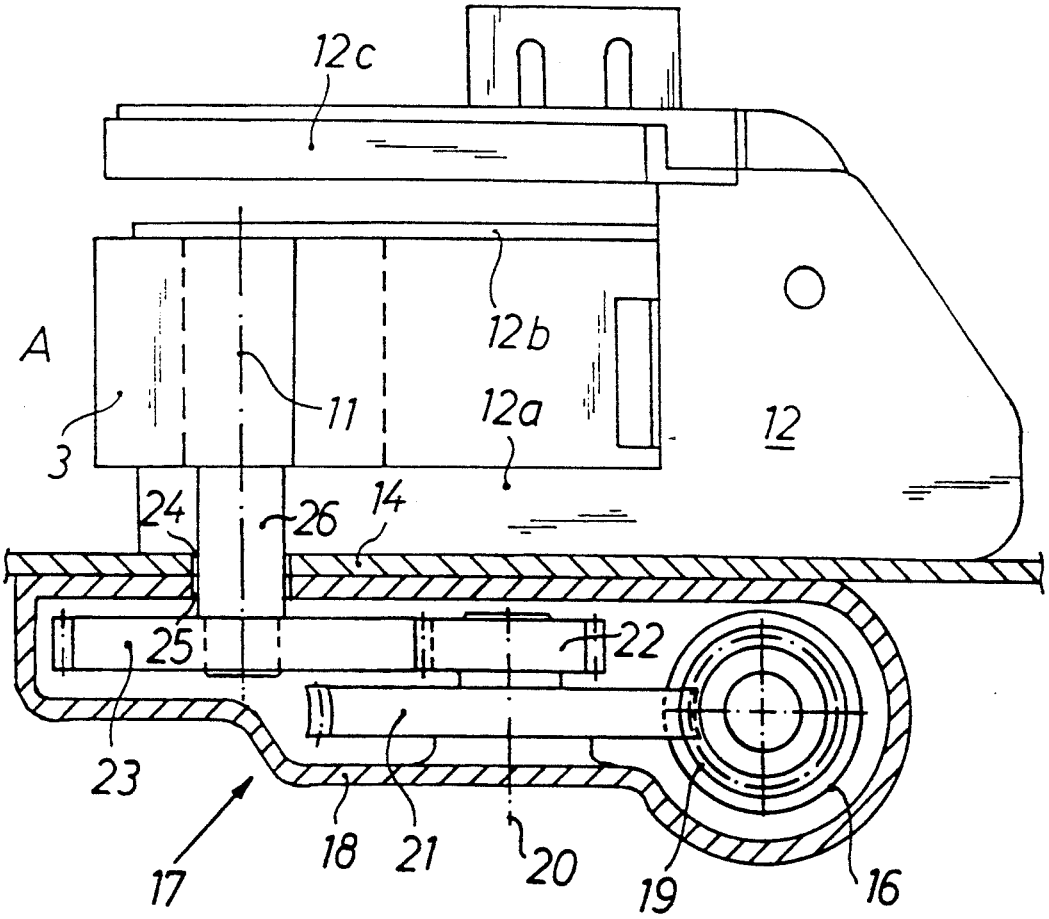
FIG. 3 is a top view of the element and the pin which can be rotated on it eccentrically.

The element 12 used in the invention is illustrated in FIG. 3 in an enlarged top view. As outlined, the element 12 has three legs 12*a*, 12*b*, 12*c* which are laterally directed to the exterior side A. The element pin 3, which is shown in the prelocking position by solid lines and in the main locking position by interrupted lines, is arranged between the two legs 12*a*, 12*b* and is connected with the legs 12*a*, 12*b* while being able to swivel about an eccentric axis developed on the two legs 12*a*, 12*b*. The third leg 12*c*, which forms a protection for the pin 3, is disposed opposite a perpendicular front face of the vehicle door which is not shown. For the fastening of the element 12 on the vertical column 14 of the door frame also shown in FIGS. 1*b* and 2*b*, the leg 12*a* is connected with this column 14 in FIG. 3.

In FIG. 3, an electric motor 16 and a gearing 17 are arranged in a housing 18 which may, for example, be divided into two parts. In the illustrated embodiment, a driving pinion 19 of the electric motor 16 drives a worm wheel 21 which can be rotated on a shaft 20 fixed to the housing 18 and which is non-rotatably connected with a smaller spur wheel 22 arranged on the same shaft 20. The small spur wheel 22 meshes with a larger spur wheel 23 which is non-rotatably connected with a shaft 26 which represents a lateral extension of the pin 3. The shaft 26 projects through an opening 24 in a side wall of the column 14 and an opening 25 in the housing 18. The fastening of the housing 18 on the column 14 may take place, for example, by means of the fastening screws for the element 12 which are not shown if these fastening screws through additional openings in the column 14 engage in fastening threads in the housing 18.

Without departing from the scope and spirit of the present invention, the lock may be implemented in numerous constructions which deviate from the illustrated embodiment. For example, the lock latch, which in the embodiment is constructed as the fork member, may be constructed as a sliding latch. Constructions are also contemplated in which the lock latch must not be prevented by a catch from a displacement into an open position. A rotation of the pin from the prelocking position into the main locking position and possibly from the main locking position into the prelocking position may also take place by deviating from the earlier described rotating angle of 180 degrees, at another arbitrary angle into a desired rotating direction. It is also not required that the pin be fastened to a element. Likewise, it is provided that, deviating from the described embodiment, the pin is eccentrically rotatably disposed not on both face areas but only on one face area. Also, although the cross-section of the pin has been described as circular for illustrative purposes, other cross-sectional shapes of the pin are also possible, the relative movement of the pin with respect to the lock latch being controllable by way of the cross-sectional shape. In addition to its use, for example, as a door lock or hood lock or the like on a motor vehicle, the lock of the present invention is also suitable for other applications in which, for example, a structural component, which can be locked by the lock, is otherwise locked in a sluggish manner.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A door lock with a servomotor for a motor vehicle, comprising:

a lock latch displaceable between an open position and a detent position;

a servomotor; and a pin having a central longitudinal axis, said pin being coupled to the servomotor such that said pin is rotatable by the servomotor about an eccentric axis parallel to the central longitudinal axis of the pin from a prelocking position into a main locking position, said lock latch reaching behind said pin in the detent position;

wherein the pin, when it is rotated from the prelocking position into the main locking position, rotates at an angle of approximately 180 degrees about the eccentric axis;

wherein the pin rotates from the main locking position into the prelocking position and from the prelocking position into the main locking position.

2. A lock according to claim 1, further comprising a catch and wherein the lock latch is a fork member which, in the detent position, is secured by the catch with respect to displacement into the open position.

3. A lock according to claim 1, wherein the pin is rotatable from the main locking position into the prelocking position by the servomotor.

4. A lock according to claim 3, further comprising a switch that, during the locking of the lock, detects the detent position of the lock latch, and switches on the servomotor in the prelocking position until the main locking position is reached.

5. A lock according to claim 4, wherein the lock latch is fastened to a vehicle door, and the pin is fastened to a door frame receiving the vehicle door.

6. A lock according to claim 1, further comprising an element to which the pin is fastened such that the pin is rotatable about the eccentric axis.

7. A lock according to claim 1, further comprising an element to which the pin is fastened such that the pin is rotatable about the eccentric axis.

8. A lock according to claim 1, wherein the servomotor is formed by an electric motor and a gearing connected behind it which interacts with the pin.

* * * * *